United States Patent [19]

Brandeau

[11] Patent Number: 4,794,691

[45] Date of Patent: Jan. 3, 1989

[54] METHOD AND APPARATUS FOR TERMINATING THIN, FLAT POWER CABLE, PARTICULARLY FOR UNDER CARPET USE

[76] Inventor: Edward P. Brandeau, 505 Sturbridge Ct., Flemington, N.J. 08822

[21] Appl. No.: 914,375

[22] Filed: Oct. 2, 1986

[51] Int. Cl.[4] ..... H01R 9/07

[52] U.S. Cl. ..... 29/861; 29/868; 29/871; 439/495

[58] Field of Search ..... 29/861, 868, 869, 871; 439/495, 496

[56] References Cited

U.S. PATENT DOCUMENTS

| | | | |
|---|---|---|---|
| 4,241,498 | 12/1980 | Brandeau | 29/861 |
| 4,274,197 | 6/1981 | Bethurum | 29/861 |
| 4,288,916 | 9/1981 | Verma | 29/861 X |
| 4,602,840 | 7/1986 | Romatzick | 29/869 X |

*Primary Examiner*—P. W. Echols
*Assistant Examiner*—Taylor J. Ross
*Attorney, Agent, or Firm*—Kenyon & Kenyon

[57] ABSTRACT

A simple and highly effective method and apparatus for field terminating flat power cable such as used in under-carpet wiring systems. Each conductor, with tightly bonded insulation, of a multi-conductor flat power cable is (at the point of installation in-situ) slotted or cut through with thin narrow slots which leave corresponding narrow rectangular openings through the insulation and conductor. Then a thin conductive device or terminal with corresponding ribs which easily though precisely fit into the slots, is placed in the slot openings, is secured in place on the cable by a suitable means, and the assembly then crimped or flattened together to give a pressure-tight high-conductivity, electrically stable termination only about twice as thick as the insulated conductor. The applicator tooling may be a simple punch and die, and a hammer or pliers. An insulating "bandage" is applied over the termination and bonded to the conductor insulation thereby giving a water-tight joint impervious to corrosion. The metal or steel top shield required by the National Electrical Code is similarly terminated in order to assure "ground" continuity.

12 Claims, 10 Drawing Sheets

METHOD AND APPARATUS FOR TERMINATING THIN, FLAT POWER CABLE, PARTICULARLY FOR UNDER CARPET USE

BACKGROUND OF THE INVENTION

In recent years the wiring of buildings and of business offices with both power and telephone cables laid under the floor carpeting has become a multi-million dollar industry. A number of companies, such as AMP and T & B, have developed wiring systems, both power and telephone, for this purpose. But so far all power systems presently on the market have one or more drawbacks. In particular, the previously available undercarpet power systems tend to be complicated, expensive and/or difficult to install.

The previously available power cable itself comprises three or more thin flat copper conductors (each of the order of 5 to 20 mils thick and about a half-inch to an inch wide) insulated by laminated layers of a tough polymer such as Mylar, DUPONT trademark. Some termination systems make contact to the cable conductor by insulation displacing contacts (IDC) of which the T & B "Dragon Tooth" connector is a leading example. However, because the insulation (e.gg. Mylar) is usually chosen to have toughness and high resistance to cut-through, these IDC contacts require high forces to apply them or else they are not completely stable and secure.

A second problem with existing power systems is the complexity of the installation procedure and the expense of the applicator tooling. One attempt to overcome this second problem is shown in U.S. Pat. No. 4,241,498. While the method and device shown in this patent gave outstanding electrical results, the considerable thickness of the termination make it impossible to use for undercarpet wiring.

Another problem with existing undercarpet power wiring systems is that they are susceptible to corrosion and the deleterious effects of moisture and water. Mylar in particular is attacked by the alkali of concrete floors (where the pH may approach 13). The effects of corrosive reagents and/or other chemicals in the presence of water and electricity has caused a number of failures in the field.

There is also the problem with existing systems of maintaining electrical continuity of the top shield, generally of steel foil, which is required by the electrical code for mechanical protection and to insure that a reliable "ground" connection is carried to the output power receptacles.

OBJECTS OF THE INVENTION

It is therefore an object of the invention to provide an undercarpet power wiring system which is simpler, and less expensive than previous systems.

It is another object to provide such a system which gives substantially improved electrical and mechanical stability, and greater corrosion resistance.

A further object is to provide a system which is much easier to install and which is safe to operate in moist or corrosive environments.

A more specific object is to provide a simple yet highly reliable termination for insulated flat power cable, the termination being only about twice the thickness of the cable conductors, and suitable for undercarpet installation.

A still further object is to provide an uncercarpet power wiring system which requires a minimum of specially tooled fittings and output receptacles so that the owner can use the system with almost any commercially available housings, fittings or receptacles.

These and other objects will be understood from the following description given in connection with the accompanying drawings.

SUMMARY OF THE INVENTION

In accordance with one embodiment of the invention there is provided a thin flat, multi-conductor power cable of special construction making it especially suited for undercarpet installation. Each conductor of the cable is covered with a very thin, pin-hole free insulating coating of a high-performance polymer which is adhesively bonded all around the flat conductor, thereby providing a waterproof construction. At the point along the cable where it is to be spliced or tapped into a receptacle, a simple punch and die are used to provide a number of narrow, long slots through insulation and conductor. This leaves clean exposed edges of the conductor along the sides of the slots. A terminal or connector device having punched-up ribs which fit closely in the slots is then inserted with the ribs protruding through the other side of the cable conductor. Then suitable means, such as a conductive locking tab inserted through the protruding loops of the ribs, locks the device onto the cable and insures precise location between them. Next, the cable and device are flattened or crimped into each other by using, for example, a pair of anvils and a hammer or pliers. This forces the protruding ribs into the slots and wedges them into very tight mechanical engagement with the cable conductor. The electrical conductivity of this joint equals or exceeds the conductivity of the cable before it was tapped or spliced. The mechanical locking and crimping of connector device to cable insures continued mechanical and electrical stability. The joint itself is only about twice the thickness of the cable conductors. After the point is crimped, a thin insulating film or "bandage" is laid over the joint and bonded by suitable means, such as heating and melting, to the cable insulation. This gives a water-tight, corrosion-resistant joint. Finally, the top metal shield is spliced together using the same technique and tooling, thereby assuring "ground" continuity.

SUMMARY OF THE DRAWINGS

The subject matter which is regarded as the invention is set forth in the appended claims. The invention itself, together with other objects and advantages thereof, will be apparent from the following description given in connection with the accompanying drawings in which:

DETAILED DESCRIPTION OF THE INVENTION

Figure 1:
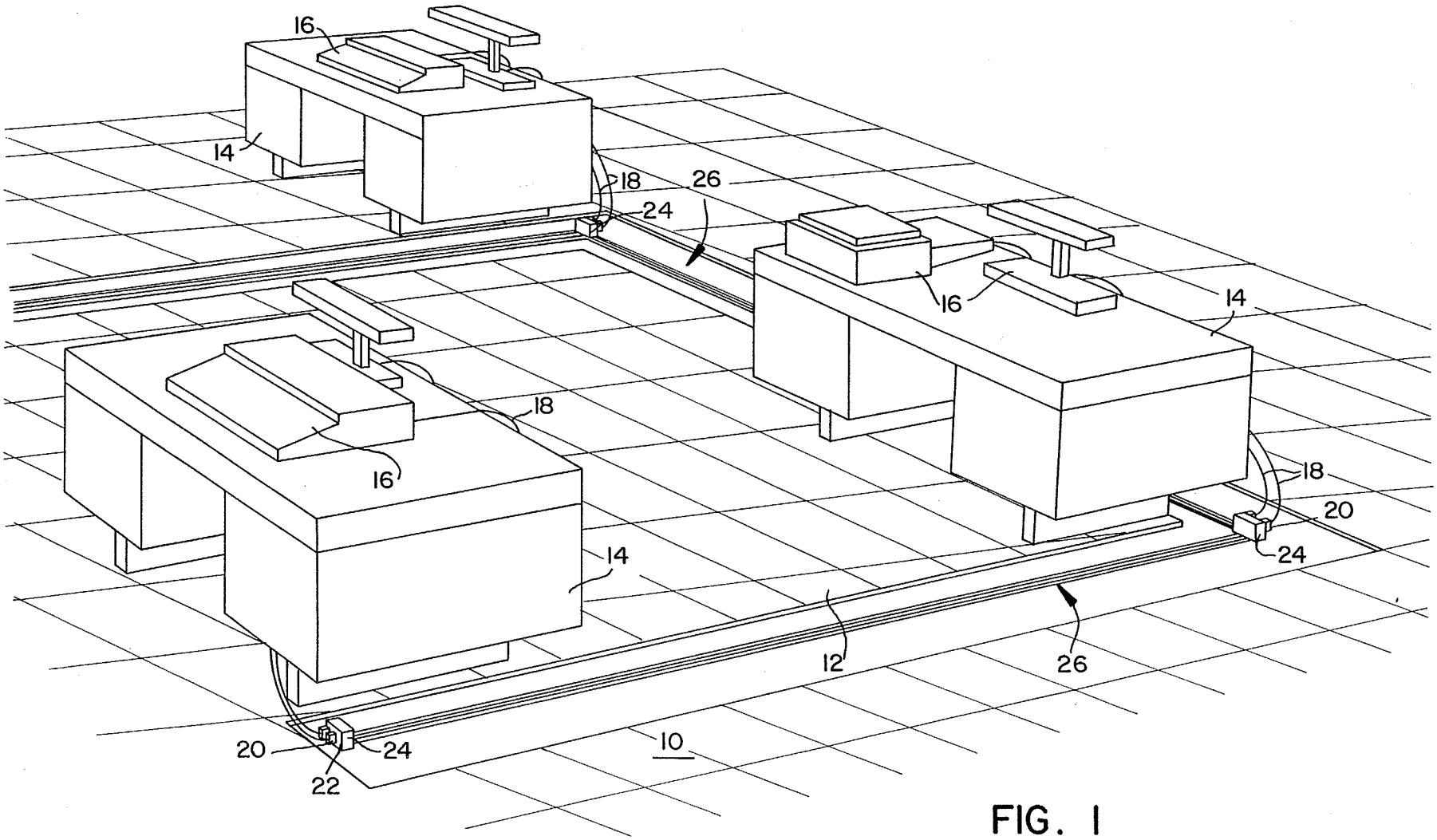
FIG. 1 is an illustrative sketch showing a flat power cable system according to the invention and which is placed under the carpet in a business office to distribute electricity to output floor receptacles from which lights, office equipment, etc. can be powered.

FIG. 1 is a schematic illustration of a business office 10 which has floor carpeting 12 (carpet squares) and a number of desks 14 conveniently arranged. On each desk is an electric appliance, or piece of equipment 16 such as a typewritter, computer, light, etc. which draws standard electric power. Each appliance is connected by its electric cord 18 and plug 20 to a standard electric outlet 22 which is mounted within a junction box 24. Each box 24 is fastened to the floor on top of carpet 12; each box 24 is served by a respective length of a thin flat power cable 26, and to which outlet 22 is connected by means of the method and apparatus provided according to this invention. The other end of power cable 26 is terminated in a distribution or circuit box (not shown).

It should be appreciated that an important advantage of running flat power cable under the carpet, aside from eliminating the need for underfloor ducting, is that to rearrange desks 14 and the locations of junction boxes 24, one merely needs to remove a square or squares of carpeting 12, re-position cable 26 (or a portion of it), and replace the carpet and re-fasten junction boxes 24 in their new locations. This is a very important cost saving in rearranging an office, doubly so since a companion undercarpet telephone wiring system with equal versatility is also available (see U.S. Pat. No. 4,155,613).

Figure 2:
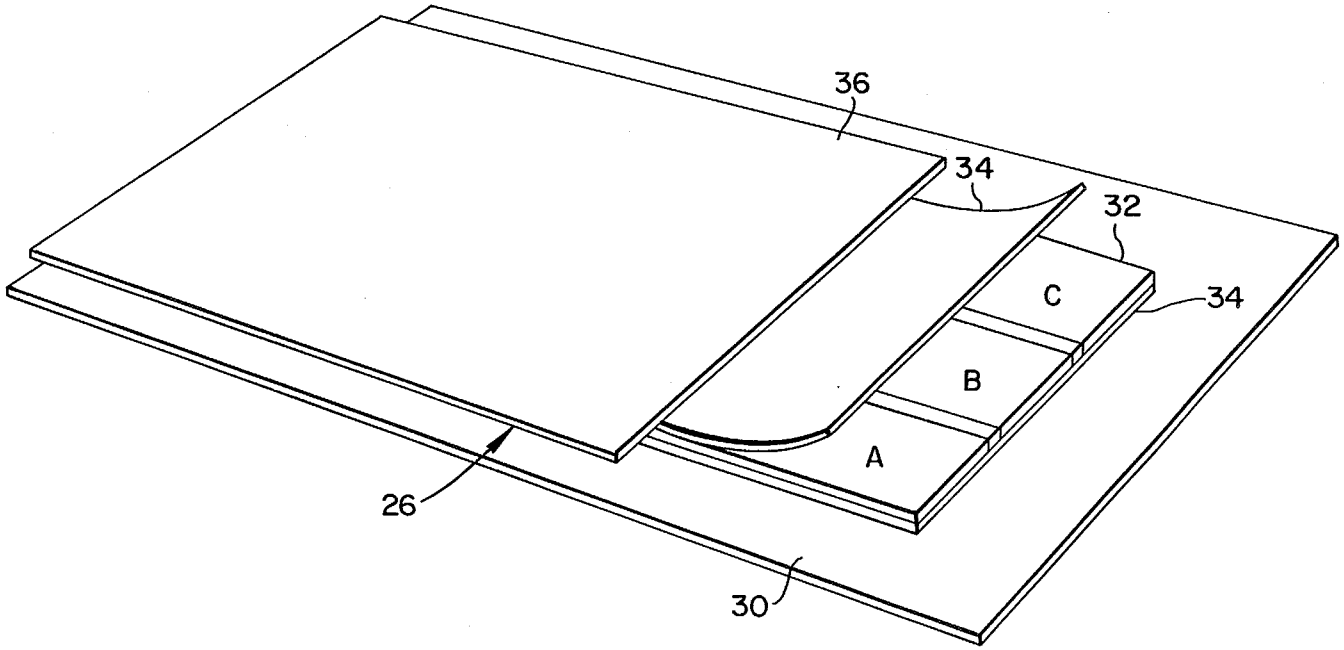
FIG. 2 is an exploded view of the flat power cable construction showing multiple cable conductors, insulation layers, and top metal shield.

FIG. 2 is an exploded view of the power cable 26 which is part of the undercarpet wiring system provided according to the invention. Laid directly on the floor (typically concrete for an office building) is a tape 30, which for example is an adhesive coated PVC about 10 mils thick and an inch or so wider than the cable itself. The purpose of this tape is to provide further insulation and a clean surface on which the power cable lies. The cable itself comprises three thin flat conductors A, B, and C to connect "power," "neutral" and "ground" of standard 120V A.C. power service. If 240V service is desired, an additional conductor or conductors (not shown) would be included with the three shown. The cable would merely be wider but otherwise of the same thickness and construction.

Adhesively or melt bonded very tightly to each conductor A, B, and C and insulating them on all sides is a thin layer of a melt bindable thermoplastic polymer 32 which is at least 1 or 2 mils thick but preferably 2 to 4 mils thick. Suitable polymers include Surlyn brand ionomer (DUPONT). This coating makes the conductors essentially proof against corrosion and water. Water cannot "wick" between insulation and conductor. If a higher temperature, more fire resistant (but more expensive polymer is needed, then Halar brand Grade 500 fluoropolymer (ALLIED) may be used for layer 32.

Insulation layer 32 is relatively thin and therefore relatively little of it is used. This makes it economical to use a high performance polymer, such as mentioned above, to make cable 26 exceptionally resistant against corrosion and water. But in order to give even greater electrical and mechanical protection to conductors A, B, and C, insulating layer 32 is covered top and bottom by layer 34 of a thicker and less expensive insulating film such as PVC. The latter, for example, is bonded to layer 32 by a suitable adhesive, such as pressure sensitive adhesive, which will permit it to be peeled back at the point along the cable where the conductors are to be spiced or tapped into. Inner insulating layer 32 however is so tightly bonded onto conductors A, B, and C that, for practical purposes, it is not easily removed. But an important feature of the invention is that it is not necessary to remove layer 32; an exceptionally stable and low resistance electrical connection is made with layer 32 left on the conductors, as will be described hereinafter. Moreover, because layer 32 remains bonded to the conductors, it is easier to obtain a completely sealed splice after a connection has been effected.

As seen in FIG. 2, cable 26 has a top metal shield 36 which is somewhat wider than the cable members underneath and which serves as a shield and barrier to tacks, staples, etc. which may fall on the floor and be driven into the electrified conductors A, B, and C. Shield 36 thus provides a degree of mechanical protection for cable 26, but in the event a nail or the like does penetrate through shield 36 into an energized conductor, an electrical short circuit occurs. To insure that the fuse or circuit breaker opens if such a short occurs, it is essential that electrical continuity of shield 36 all the way back to the circuit box (not shown) be maintained.

Shield 36 is typically made of steel about 8 to 10 mils thick, with suitable corrosion protection, such as zinc cladding (galvanizing) and/or anti-corrosion varnish. Because of the stiffness of shield 36, it is not possible to fold it upon itself in order to turn a corner; the fold would be too thick to lie underneath a carpet without an unsightly bulge. Therefore at each turn or corner where cable 26 changes direction, it is necessary to cut top shield 36 and lay it at an angle upon itself. This poses the problem of maintaining absolute electrical continuity of the shield. The present invention also easily solves this problem, as will shortly be explained.

Figure 3:
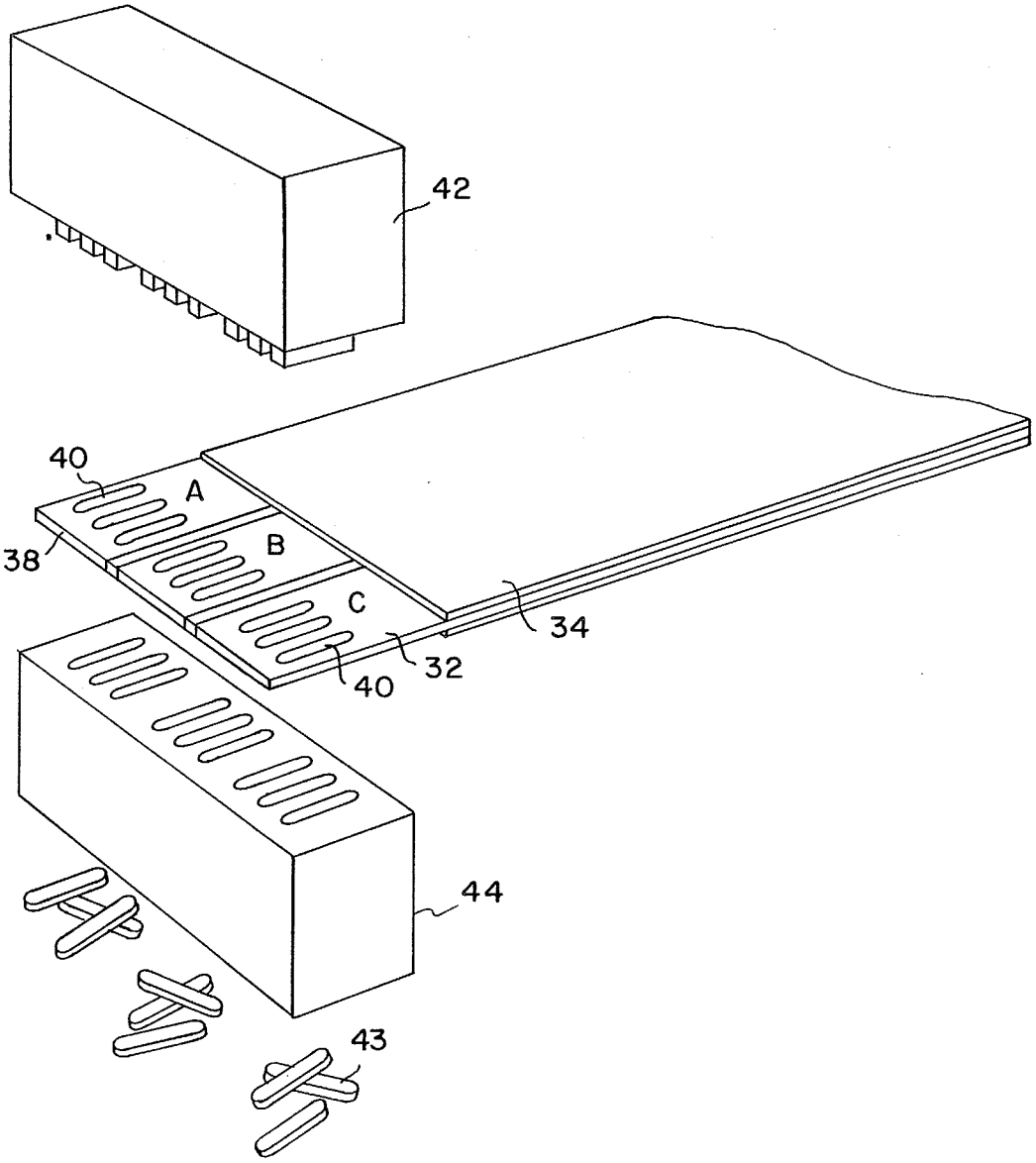
FIG. 3 is an enlarged view of a portion of the cable, without top shield, showing the slots provided according to one embodiment of the invention, the applicator tooling being shown apart from the cable.

FIG. 3 shows that portion of cable 26 comprising conductors A, B, and C and insulating layer 32, but with insulating layer 34 peeled back, and top metal shield 36 not yet in place.

Conductors A, B, and C have been cut along a common edge 38; slightly to the right of this edge a series of slots 40 provided according to the invention, have been punched through the insulation and metal of the conductors. The slots 40 are positioned and proportioned approximately as shown, there being for example three slots 40 in each conductor. These slots are put in with great precision and accuracy by a simple punch and die set 42, 44 shown apart from the cable. The force to actuate the punch and die may be provided by a hammer or a simple hand press (not shown). Scrap slugs 43 which were punched out of slots 40 are thrown away.

Figure 4:
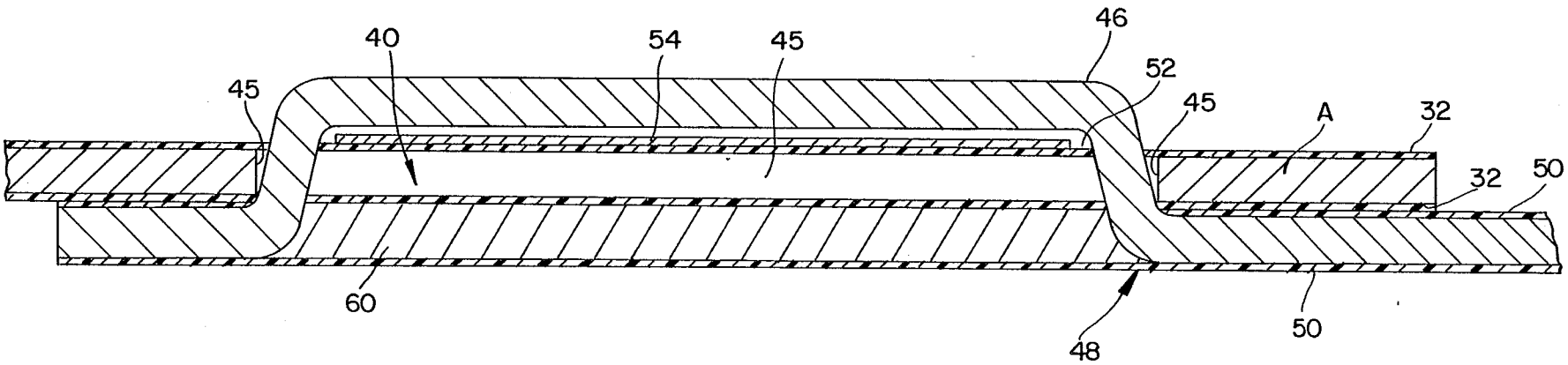
FIG. 4 is a further enlarged view taken as indicated by lines 4—4 in FIG. 5, and showing the terminal device with its ribs inserted through the slots and with a locking tab threaded through the rib loops.
Figure 5:
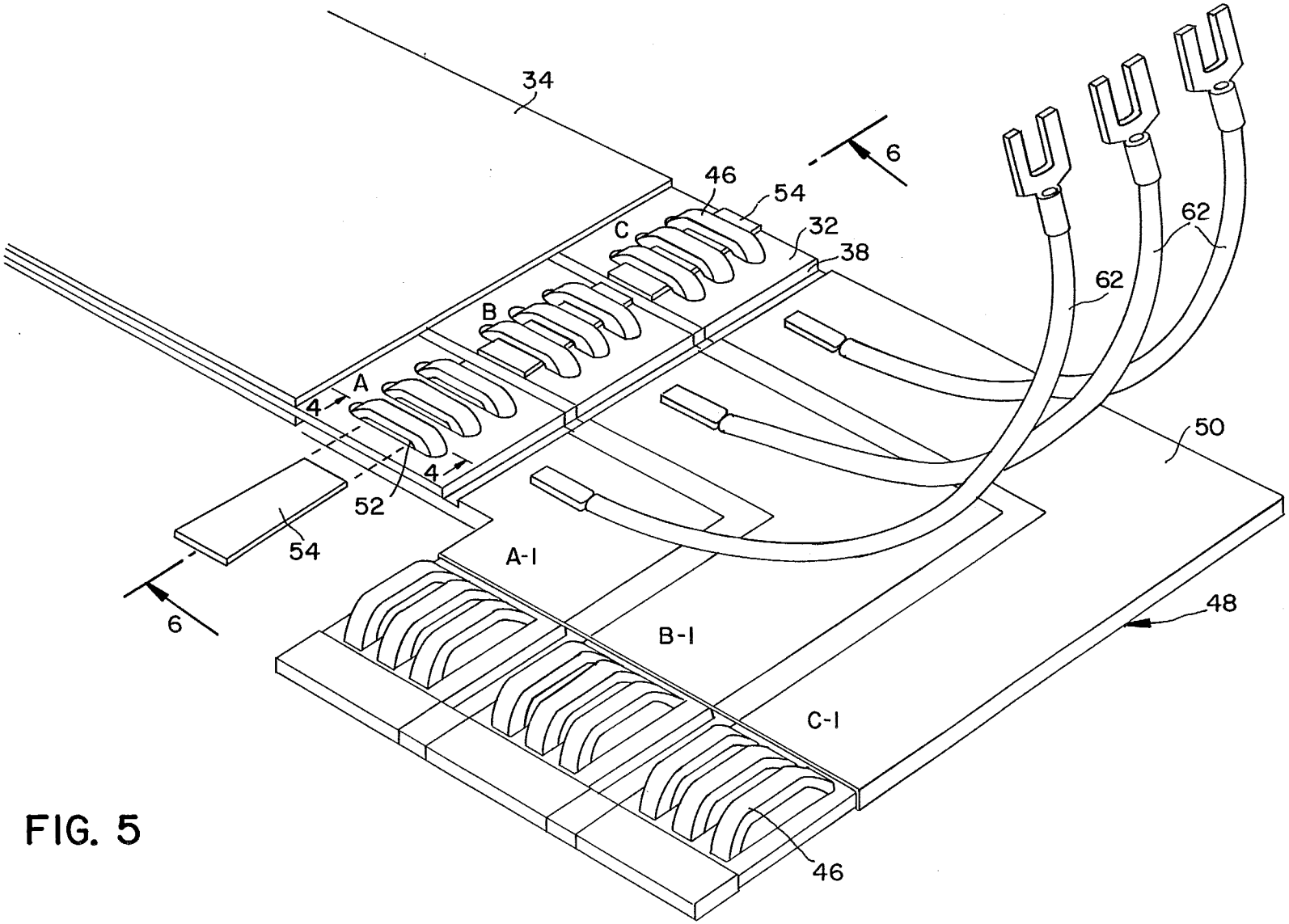
FIG. 5 shows the terminal device after it has been inserted onto the cable.

FIG. 4 shows in enlarged detail one of the slots 40 previously cut through conductor A and insulating layer 32. In side the slot a clean edge 45 of the conductor is exposed along the sides and ends of the slot. The areas of these conductor edges 45 are greater than the crosssectional area of the conductor. Protruding through the slot is a hoop or rib 46 integral with a terminal device 48. The latter, seen also in FIG. 5, is a factory-supplied part with conductive arms A-1, B-1, and C-1 having the same general form, thickness and conductivity as conductors A, B, and C. The arms of device 48 are similarly insulated and mechanically held together by a thin layer 50 of a polymer adhesively bonded to them, except for ribs 46 which are left bare. This layer 50 is advantageously identical to layer 32; the layers are melt-bondable one to the other and to the metal of the conductors.

As seen in FIG. 5 each arm of device 48 in the embodiment illustrated, has three lanced-up ribs 46 on each end, these ribs exactly fitting into the slots 40 punched through the cable conductors. Referring also to FIG. 4, each rib 46 fits easily but closely through its respective slot 40 and protrudes above the top layer 32 of each conductor leaving a small clearance gap 52. Threaded through this gap is a respective one of the tabs or buckles 54. Each tab is slightly tapered along its width and upon being inserted sufficiently into a gap 52 is wedged tightly under the three ribs it engages. Each tab 54 is advantageously made of high-conductivity and strength, and is about 2 to 4 mils thick. Each tab is suitably plated, (e.g., solder of 60% tin, 40% lead) preferably to a thickness of several hundred microinches. The surface of each tab is slightly grooved or knarled and a non-corrosive flux such as rosin is deposited thereon. The ribs are similarly plated and are uninsulated.

Figure 6A:
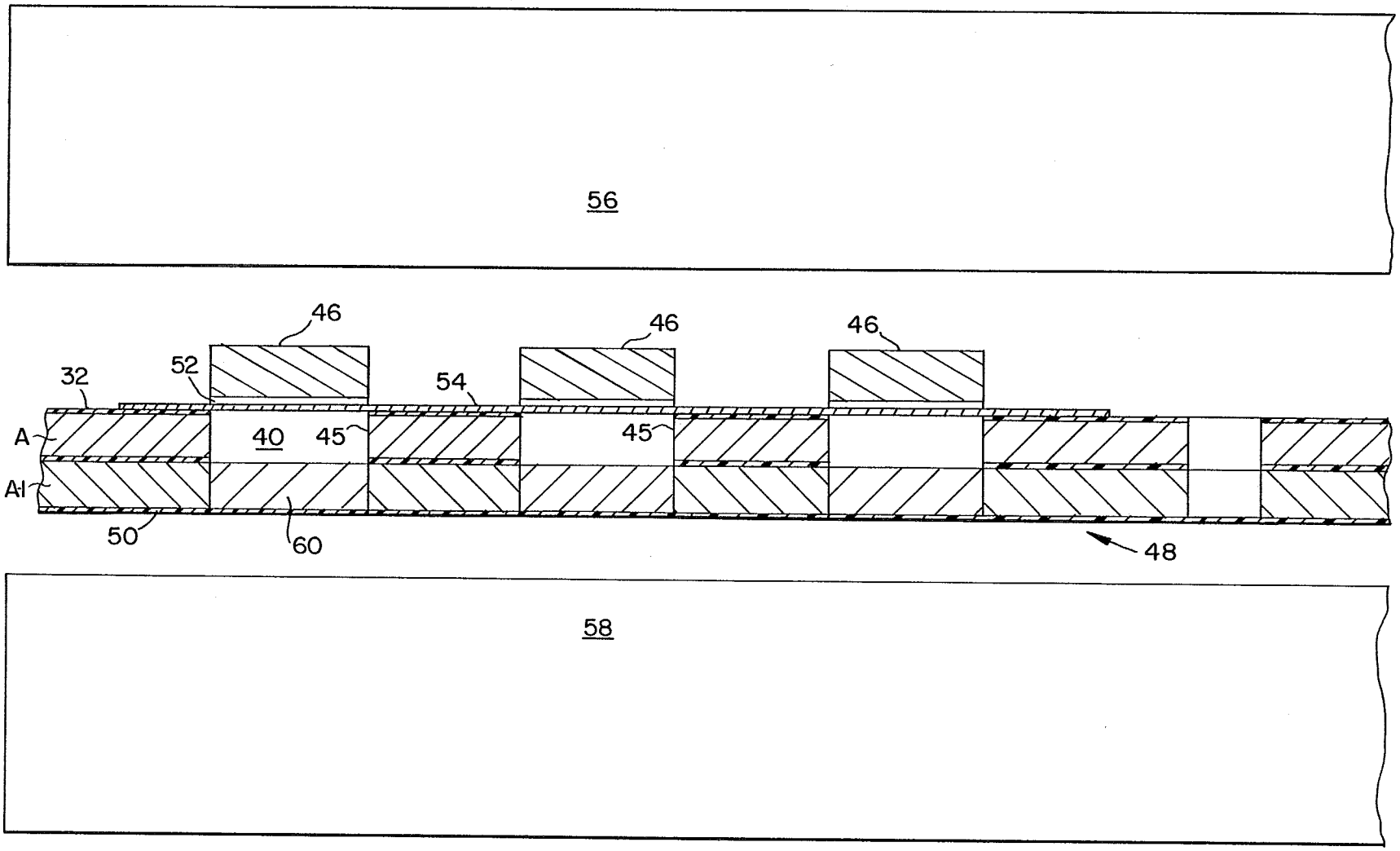
FIGS. 6A and 6B are further enlarged cross section taken as indicated by lines 6—6 in FIG. 5 showing the thin, tight, mechanically locked joint which has been effected both before and after it has been crimped. The parts are shown substantially to scale.
Figure 6B:
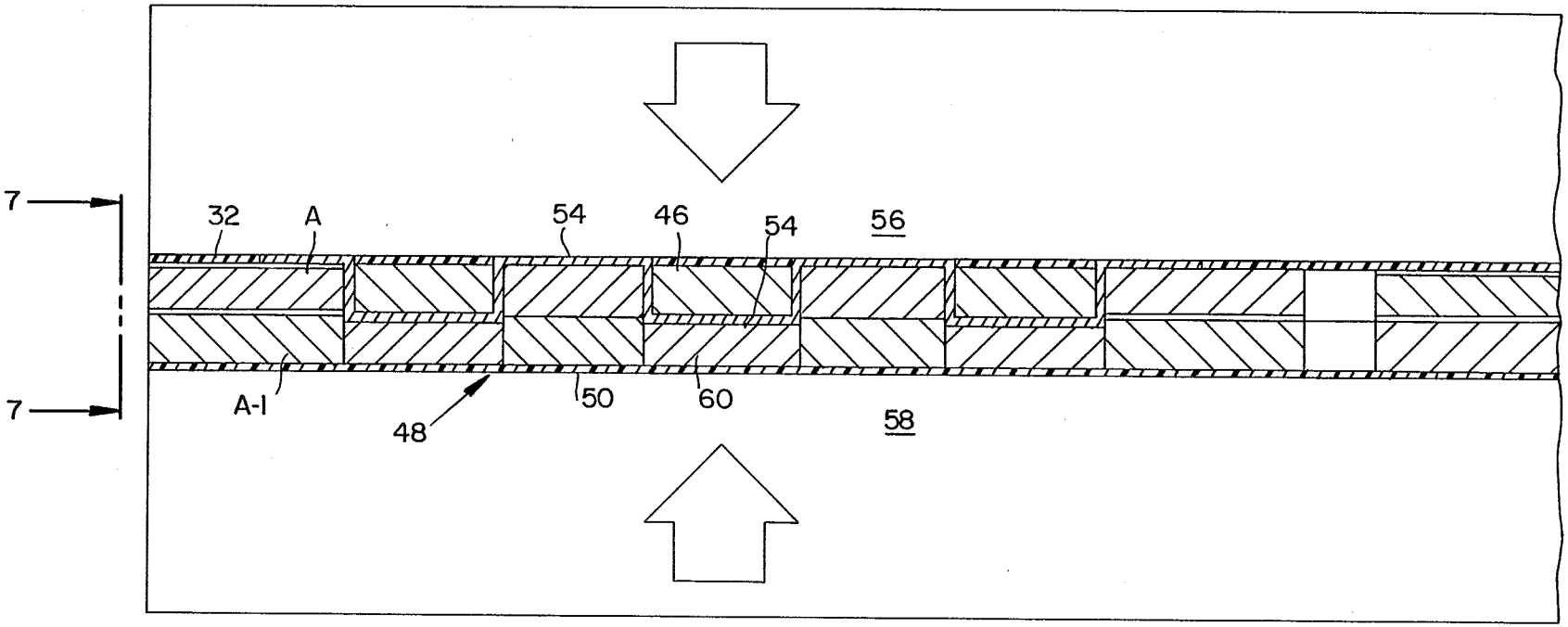

After device 48 is locked onto cable conductors A, B, and C by ribs 46 and tabs 54, the assembly is crimped or flattened between a top anvil 56 and a bottom anvil 58, shown schematically in FIGS. 6A and 6B. This forces the ribs down into slots 40, and because of the added presence of tab 54 gives a very tight press-fit against the clean sheared edges 45 of the conductor. This crimping action both slides and stretches the tab and provides a clean, tight interface between ribs 46 and conductor slot edges 45. Very high residual radial forces in the plane of conductors A, B, and C maintain gas-tight enagement between edges 45 and the sides and ends of ribs 46.

Figure 7:
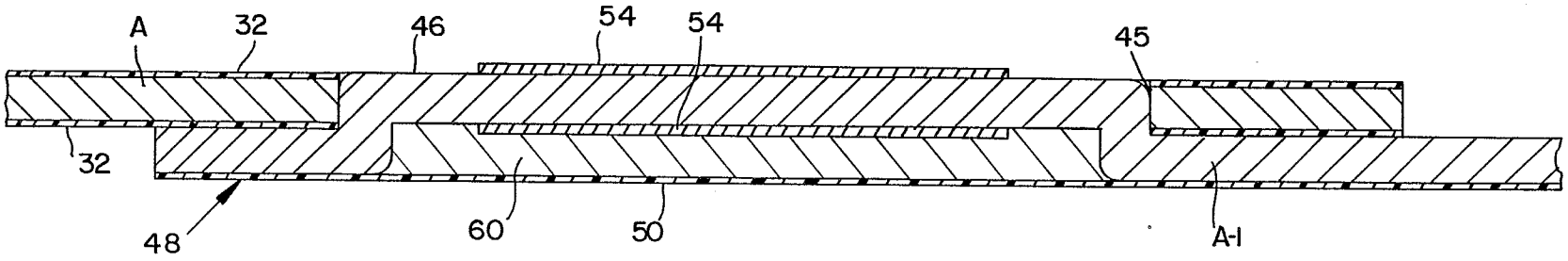
FIG. 7 is another cross section taken as indicated by lines 7—7 in FIG. 6B.

As seen in FIGS. 4 and 7, the voids left where ribs 46 are lanced-up from device 48 are filled in by volume of solder 60. Each rib 46 is proportioned so that it fits easily but closely into its respective slot 40. The thinness of each tab 54 is such that it threads easily through a respective opening 52, but is sufficiently strong and together with rib 46 forms a press-fit into slot 40. In other words, the volume of a rib 46 added to that portion of a tab 54 forced into the slot is slightly greater than the volume of the slot. This exerts great radial pressure against the sides and ends of the slot thereby insuring a tight mechanical and electrical joint. The solder present at the interface may subsequently be re-flowed and will "wet" the bare edges of conductor in slots 40 further enhancing electrical and mechanical stability of the joint. The power handling capacity of the cable is essentially unaffected by the presence or absence of the connector device. The thickness of the joint is only about twice the thickness of connector device 48. In the embodiment illustrated, conductors A, B, and C are each 600 mils wide by 14 mils thick (10 ga AWG). Insulation 32 is slightly over 2 inches wide and about 2 to 3 mils thick on each side of the conductors. Device 48 is 16 mils thick. Slots 40 are each about 300 mils long and about 50 mils wide.

As seen in FIG. 5, the unterminated end of connector device 48 is proivded with ribs 46 to engage respective slots in the conductors of another length of cable 26 (not shown). The terminating proceudre is identical to that described above. It should be understood however that one end of device 48 may be provided instead (or in addition to) with stranded-wire pigtails (of suitable conductivity) which are easily attached to a standard electrical socket such as receptacle 22 in FIG. 1. These pigtails are shown at 62 and only in FIG. 5. It should also be understood that the cable conductors A, B, and C shown cut along edge 38 in FIGS. 3 and 5, need not be cut at all in order to be terminated to device 48. Slots 40 can easily be put at any point along a continuous length of cable. Thus branching, tapping or splicing are all easily accomplished as described above. The configuration of device 48, shown as a right-angle fitting in FIG. 5, can easily be made straight, or in various different angles and shapes.

It will be appreciated that the precision and the gang terminating of all of the conductors of the cable at the same time and with a unitary connector device, which has ease of field installation of this power wiring system. a precise factory configuration, adds greatly to the The reliability of the system is not critically dependent on the skill of the installer. Moreover the basic applicator tooling is very simple and inexpensive. A variety of connecting devices 48 can be provided inexpensively.

Figure 8:
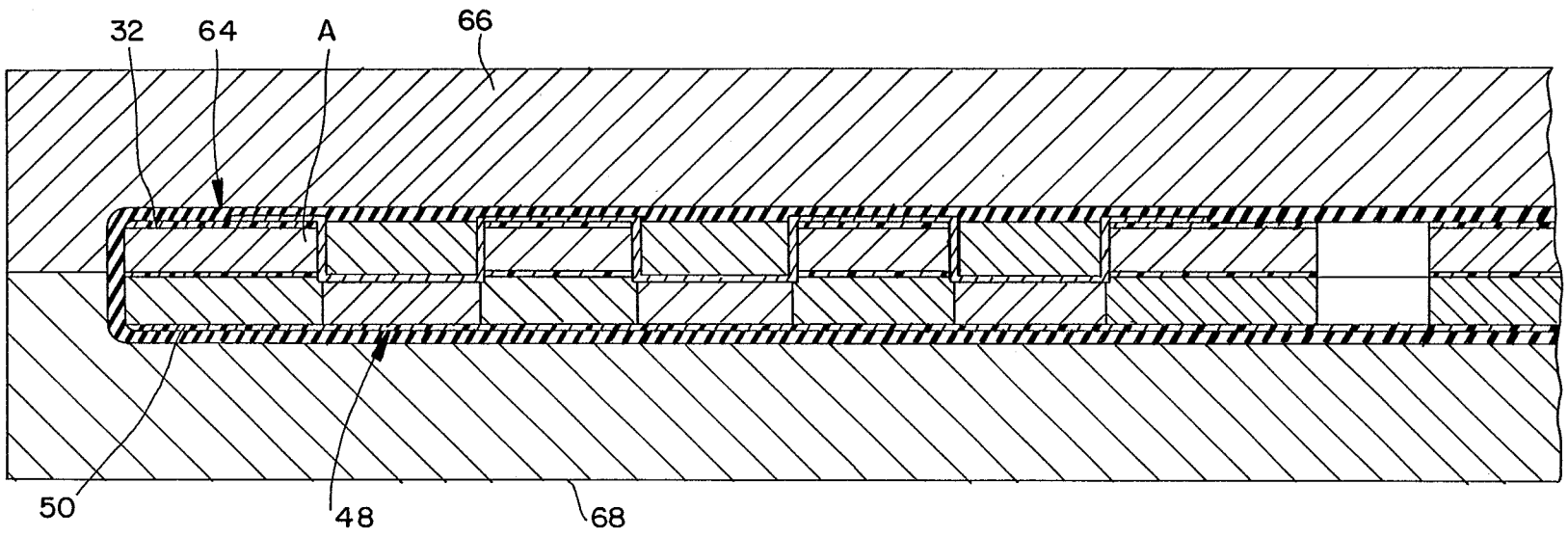
FIG. 8 shows the crimped joint covered and seal by top and bottom layers of an insulating "bandage"

After device 48 is crimped onto the cable conductors a layer of insulation is bonded over the joint. Thus as seen in FIG. 8 a factory-cut "bandage" 64 of thin insulation is wrapped around the crimped joint of deice 48 onto the conductors (A, B, and C) of cable 26. This bandage 64 is advantageously of the same polymer material as layers 32 and 50 and therefore melt-bondable to them. As seen in FIG. 8 a top mold part 66 and a bottom part 68 confine the bandage around the joint and apply modest heat and pressure to the materials, polymer and metal, captivated between the top and tottom of the mold. In a short time the polymer material is melted and fused to itself and to the exposed metal of the conductors. The temperature and heat involved in this is readily transmitted through the high conductivity metal parts and is sufficient to melt and reflow the solder or plating present within the joint and at the conductor interfaces. After the joint is sealed, it is substantially as corrosion and water proof as the cable itself, and moreover the metal parts have been "soldered" as well as crimped. This results in a joint which is extremely resistant to abuse, to the entrance of water or moisture, to corrosion, and to ordinary loosening-up (increasing resistance) over the years. A typical temperature used in melting and re-flowing the various materials is 500° F. to 800° F.; this is easily attainable with an electric iron, for example. Once melt temperature is reached, bonding and re-flowing take only a few seconds, with only a few pounds of force.

Figure 9:
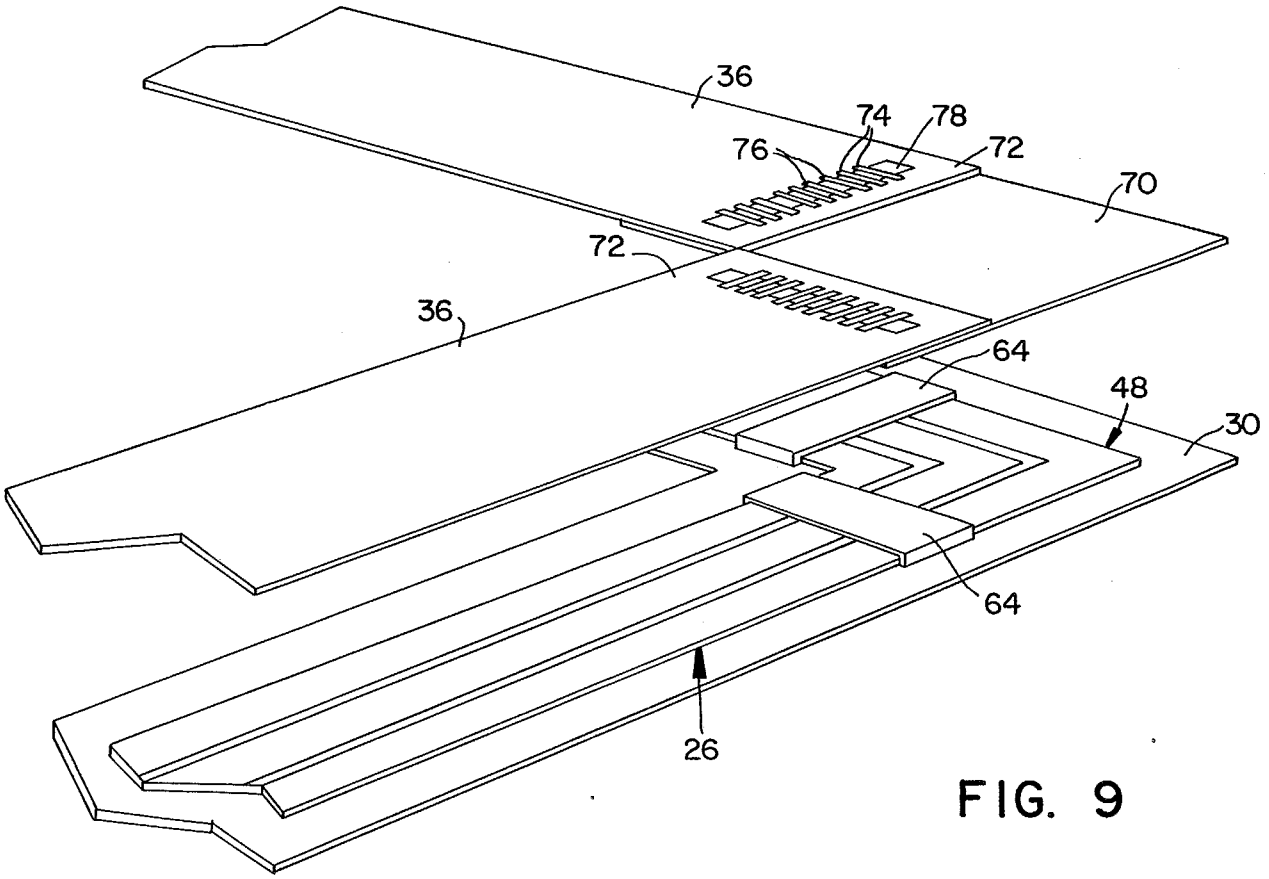
FIG. 9 shows the final joint after the insulation bandage has been bonded in place, and the top shield has been spliced to itself and ready to be put back in place.

After bandage 64 has been sealed around the joint, top metal shield 36 can be placed over it. As seen in FIG. 9, in order to turn a corner, it is necesary to cut the shield for the reasons given above. In order to insure the electrical continuity of the shield, and as seen in FIG. 9, there is provided a splicing" corner 70 which is mechanically and electrically terminated to the ends 72 of the shield. Thus each shield end 72 is provided with slots 74, which are made by the same punch and die 42, 44 used to make slots 40. Splicing corner 70 is a factory made part which has lanced-up ribs 76, substantially identical to ribs 46, and which fit precisely into slots 74. Then locking tabs 78, which may be identical to tabs 54, are inserted under the ribs 76, as in FIG. 4, and the parts crimped together as in FIGS. 6 and 7 using the same anvils and applicator tooling. Splicing corner 70 may be of the identical material as shield 36; ribs 76 and tabs 78 are suitably plated (e.g. solder) to resist corrosion and to provide a good electrical joint between the ends of the shield and corner 70.

It will be appreciated by those skilled in the art that this invention provides an improved undercarpet power wiring system in that this system is easy to install, very reliable, and yet inexpensive to manufacture. It requires only simple and inexpensive applicator tooling. The system is extremely versatile in the manner of its installation and can be safely used in difficult and harsh environments, especially where moisture, corrosion or fire hazards are present.

The above description is intended as an illustration and not a limitation of the invention. Various changes or modifications in the embodiment given may occur to those skilled in the art upon a reading of the specificati-9on and can be made without departing from the spirit or scope of the invention as set forth in the claims.

What is claimed is:

1. A method of field terminating flat power cable having one or more wide, thin conductors, each conductor being insulated comprising the steps of: punching a slot or slots through the conductor and insulation, inserting a narrow upstanding rib or ribs of a connecting device through said slot or slots, holding the rib or ribs and the conductor together, and crimping or flattening the rib or ribs and conductor tightly together to wedge the conductor and connecting device together and establish a high residual radial force giving a gas-tight electrical joint, the conductor and connecting device being mechanically secured together by the residual force.

2. The method in claim 1 in further combination with the steps of: placing a thin insulating bandage over the joint, and bonding the bandage to the insulation and conductor of the joint to seal it against water and corrosion.

3. The method in claim 2 wherein the bandage is bonded by heat and pressure applied in situ.

4. An improved electrical and mechanical joint between a thin flat insulated power conductor and a connecting deivce; said power conductor comprising a first conductor having narrow rectangular slots punched through it, said connecting device comprising a second conductor having narrow rectangular ribs fitted closely thorugh said slots, the ribs of said second conductor being flattened and wedged tightly into said slots thereby exerting great force in the plane of said first conductor, the volume of conductive metal filling said slots being at least equal to the volume removed to form the slots whereby the conductivity of the joint at least equals the conductivity of either said first or second conductor.

5. The joint in claim 4 wherein said ribs are heavily coated with solder, the solder being melted and reflowed onto portions of said first conductor.

6. The joint in claim 4 in further combination with a locking tab inserted between said ribs and first conductor, portions of said tab being wedged between said ribs and slots.

7. An undercarpet power wiring sytem comprising: a thin flat multi-conductor power cable, each conductor being insulated by a polymer bonded to the conductor which prevents corrosionn and wicking of water into the cable, a top shield of a tough puncture resistant metal such as steel, output connecting means for said conductors including ribs and slots, the slots being punched through one of a mating deivce and said conductors, the ribs being precisely formed in the other of said device and conductors, the ribs and slots being crimped in-situ to give a gas-tight electrical joint between said device and conductors, the volume of metal crimped into said slots slightly exceeding the volume of the slots, whereby a high-force contact is effected, a bandage layer of insulation covering said joint, and a shield and connected to said shield, said shield and corner having mating slots and ribs wedged into each other.

8. The system in claim 7 wherein a first locking tab is provided between said ribs and slots of said cable conductors, and device, and a second locking tab is provided between the ribs and slots of said shield and corner.

9. The system in claim 8 wherein each said tab is tapered in width.

10. The system in claim 8 wherein each said tab is solder and flux coated.

11. A method of making a thin yet highly reliable electrical termination in an insulated flat electrical conductor compising the steps of; cutting out a slot through said insulated conductor, inserting into said slot a conductive portion of a terminating device, squeezing said portion and conductor flat and tightly together to form a joint, the volume of said squeezed conductive portion slightly exceeding the volume of said slot, and applying a bandage of insulation over said joint.

12. The method in claim 11 wherein the bandage of insulation is melt bonded to the insulation of the conductor under heat and pressure whereby a tight mechanically and physically thin termination is effected

* * * * *

UNITED STATES PATENT AND TRADEMARK OFFICE

CERTIFICATE OF CORRECTION

PATENT NO. : 4,794,691

DATED : Jan. 3, 1989

INVENTOR(S) : Brandeau

It is certified that error appears in the above-identified patent and that said Letters Patent is hereby corrected as shown below:

Col. 1, line 26, change "e.gg." to --e.g.--.

Col. 3, line 12, change "seal" to --sealed--.

Col. 4, line 67, change "In side" to --Inside--.

Col. 5, line 2, change "crosssectional" to --cross-sectional--.

Col. 5, line 25, insert --copper or copper alloy of suitable temper-- between "high-conductivity" and "and".

Col. 5, line 28, change "microinches" to --micro-inches--.

Col. 6, line 6, change "proceudre" to --procedure--.

Col. 6, line 25, "has ease" should read --has a precise factory configuration, adds greatly to the ease--; line 26, delete "a precise factory configuration, adds greatly to the".

Col. 6, line 34, change "deice" to --device--.

Col. 6, line 49, change "move-", to --more---.

UNITED STATES PATENT AND TRADEMARK OFFICE

CERTIFICATE OF CORRECTION

PATENT NO. : 4,794,691

DATED : Jan. 3, 1989

INVENTOR(S) : Brandeau

It is certified that error appears in the above-identified patent and that said Letters Patent is hereby corrected as shown below:

Col. 7, line 50, change "deivce" to --device--.

Col. 8, line 29, "shield and connected" should read -- shield corner connected --.

Col. 8, line 34, change "ductors," to -- ductors --.

Signed and Sealed this

Second Day of January, 1990

*Attest:*

JEFFREY M. SAMUELS

*Attesting Officer*

*Acting Commissioner of Patents and Trademarks*